US007932705B2

(12) United States Patent
Kim et al.

(10) Patent No.: US 7,932,705 B2
(45) Date of Patent: Apr. 26, 2011

(54) VARIABLE INPUT VOLTAGE REGULATOR

(75) Inventors: Seongwon Kim, Old Tappan, NJ (US); Daniel M. Dreps, Georgetown, TX (US)

(73) Assignee: International Business Machines Corporation, Armonk, NY (US)

( * ) Notice: Subject to any disclaimer, the term of this patent is extended or adjusted under 35 U.S.C. 154(b) by 215 days.

(21) Appl. No.: 12/178,678

(22) Filed: Jul. 24, 2008

(65) Prior Publication Data

US 2010/0019744 A1 Jan. 28, 2010

(51) Int. Cl.
*G05F 1/563* (2006.01)
*G05F 1/59* (2006.01)
*G05F 5/08* (2006.01)

(52) U.S. Cl. ..... 323/266; 323/269; 323/303

(58) Field of Classification Search ..... 323/266, 323/299, 303, 311–317, 268, 269, 273
See application file for complete search history.

(56) References Cited

U.S. PATENT DOCUMENTS 5,272,432 A * 12/1993 Nguyen et al. ..... 323/315
5,513,135 A 4/1996 Dell et al.
5,666,078 A 9/1997 Lamphier et al.
5,687,330 A 11/1997 Gist et al.
5,739,681 A * 4/1998 Allman ..... 323/314
6,133,749 A 10/2000 Hansen et al.
6,177,785 B1 1/2001 Lee
6,208,127 B1 3/2001 Doluca
6,381,685 B2 4/2002 Dell et al.
6,426,671 B1 * 7/2002 Kono ..... 327/541
6,449,676 B1 9/2002 Johari et al.
6,587,896 B1 7/2003 Baldwin et al.
6,801,025 B2 10/2004 Carballo et al.
6,922,074 B2 7/2005 Coughlin, Jr. et al.
6,992,473 B2 * 1/2006 Marschalkowski et al. .. 323/315
7,038,498 B2 5/2006 Funaba
7,180,386 B2 2/2007 Thompson et al.
7,194,559 B2 3/2007 Salmon et al.
7,218,084 B2 5/2007 Pons et al.
7,336,058 B1 2/2008 Lo et al.
2004/0263143 A1 * 12/2004 Lee ..... 323/312
2004/0264256 A1 12/2004 Mauritz et al.
2004/0268161 A1 12/2004 Ross
2006/0274595 A1 * 12/2006 Byeon et al. ..... 365/226
2008/0054935 A1 3/2008 Pan
2009/0206952 A1 * 8/2009 Dreps et al. ..... 333/181

OTHER PUBLICATIONS

Daniel M. Dreps, et al., U.S. Appl. No. 12/030,946, filed Feb. 14, 2008; "Delay Line Regulation Using High-Frequency Micro-Regulators".

* cited by examiner

*Primary Examiner* — Jeffrey L Sterrett
*Assistant Examiner* — Fred E Finch, III
(74) *Attorney, Agent, or Firm* — Cantor Colburn LLP

(57) ABSTRACT

A variable input voltage regulator includes a first circuit configured to convert a first voltage from a first voltage source to a first current, and a second circuit electrically coupled to the first circuit and configured to mirror the first current to a voltage output node. The variable input voltage regulator further includes a third circuit electrically coupled to the voltage output node of the second circuit and configured to supply additional current to the voltage output node from a second voltage of a second voltage source in response to a control input.

24 Claims, 4 Drawing Sheets

VARIABLE INPUT VOLTAGE REGULATOR

BACKGROUND

This invention relates generally to voltage regulation, and more particularly to a variable input voltage regulator for on-chip voltage regulation.

Contemporary high performance computing main memory systems are generally composed of one or more dynamic random access memory (DRAM) devices, which are connected to one or more processors via one or more memory control elements. Overall computer system performance is affected by each of the key elements of the computer structure, including the performance/structure of the processor(s), any memory cache(s), the input/output (I/O) subsystem(s), the efficiency of the memory control function(s), the main memory device(s), and the type and structure of the memory interconnect interface(s).

Typical memory buffers used to interface with DRAM devices have a core voltage rail and additional rails to supply memory device voltage and other functions. With each generation of memory device technology, the memory device voltage rail has been reduced to correspond with increased memory device frequencies.

SUMMARY

An exemplary embodiment is a variable input voltage regulator that includes a first circuit configured to convert a first voltage from a first voltage source to a first current, and a second circuit electrically coupled to the first circuit and configured to mirror the first current to a voltage output node. The variable input voltage regulator further includes a third circuit electrically coupled to the voltage output node of the second circuit and configured to supply additional current to the voltage output node from a second voltage of a second voltage source in response to a control input.

Another exemplary embodiment is a system for variable input voltage regulation. The system includes a low frequency regulator with a variable input voltage reference circuit electrically coupled to an error amplifier and a switching circuit. The variable input voltage reference circuit is configured to supply additional current from a second voltage of a second voltage source to a first current from a first voltage of a first voltage source to produce a reference voltage in response to a control input. The system also includes a plurality of micro-regulators electrically coupled to an output of the low frequency regulator. The plurality of micro-regulators filter noise in a higher frequency range as compared to the low frequency regulator.

A further exemplary embodiment is a method for variable input voltage regulation. The method includes converting a first voltage from a first voltage source to a first current and mirroring the first current to a voltage output node. The method further includes configuring a control input to supply additional current to the voltage output node from a second voltage of a second voltage source in response to the control input.

An additional exemplary embodiment is a design structure tangibly embodied in a machine-readable medium for designing, manufacturing, or testing an integrated circuit. The design structure includes a first circuit configured to convert a first voltage from a first voltage source to a first current, and a second circuit electrically coupled to the first circuit and configured to mirror the first current to a voltage output node. The design structure further includes a third circuit electrically coupled to the voltage output node of the second circuit and configured to supply additional current to the voltage output node from a second voltage of a second voltage source in response to a control input.

Other systems, methods, design structures, and/or apparatuses according to embodiments will be or become apparent to one with skill in the art upon review of the following drawings and detailed description. It is intended that all such additional systems, methods, design structures, and/or apparatuses be included within this description, be within the scope of the present invention, and be protected by the accompanying claims.

BRIEF DESCRIPTION OF THE SEVERAL VIEWS OF THE DRAWINGS

Referring now to the drawings wherein like elements are numbered alike in the several FIGURES.

DETAILED DESCRIPTION

The invention as described herein provides a variable input voltage regulator for on-chip voltage regulation. As multiple generations of double-data-rate (DDR) synchronous dynamic random access memory (SDRAM) devices have been developed, each generation has different power supply requirements. For example, the power supply requirements for various generations of DDR SDRAM are: 1.8 Volts for DDR2, 1.5 Volts for DDR3, 1.35 Volts for DDR3+, and 1.2 Volts for DDR4. A memory buffer that controls access to memory devices is constrained in size and power, particularly when integrated onto a dual inline memory module (DIMM) along with memory devices. Typical memory buffers have a core voltage rail, a DDR rail, and an analog power supply for one or more phase locked loops (PLL). Creating additional rails to support physical memory interface circuitry (DDR PHY) derived from the many possible power supply voltages would add to packaging costs and may reduce available area for other circuits in the memory buffer device. In an exemplary embodiment, a variable input voltage regulator for on-chip voltage regulation is provided that produces a fixed voltage within a tolerance band over a range of power supply voltages. The variable input voltage regulator, as described in greater detail herein, enables a DDR PHY to use a single voltage rail, producing a quiet voltage for analog circuits.

In an exemplary embodiment, the variable input voltage regulator regulates a reference voltage from a DDR rail ranging between 1.8V to 1.2V and effectively filters noise to supply delay lines that are static complementary metal-oxide-semiconductor (CMOS) circuits. This allows an on-chip voltage step down to 1.0-0.8V with an effective filter of over 20 dB. Thus, the variable input voltage regulator can maintain a single rail for the entire DDR PHY. Using mode pin adjustments, a fine delay step adjustment of the variable input voltage regulator enables adjustments between 1.0-0.8V using a voltage reference (Vref) circuit. Additionally, the Vref circuit achieves supply sequence independence between a digital supply voltage (Vddd) and an analog supply voltage (Vddr).

Figure 1:
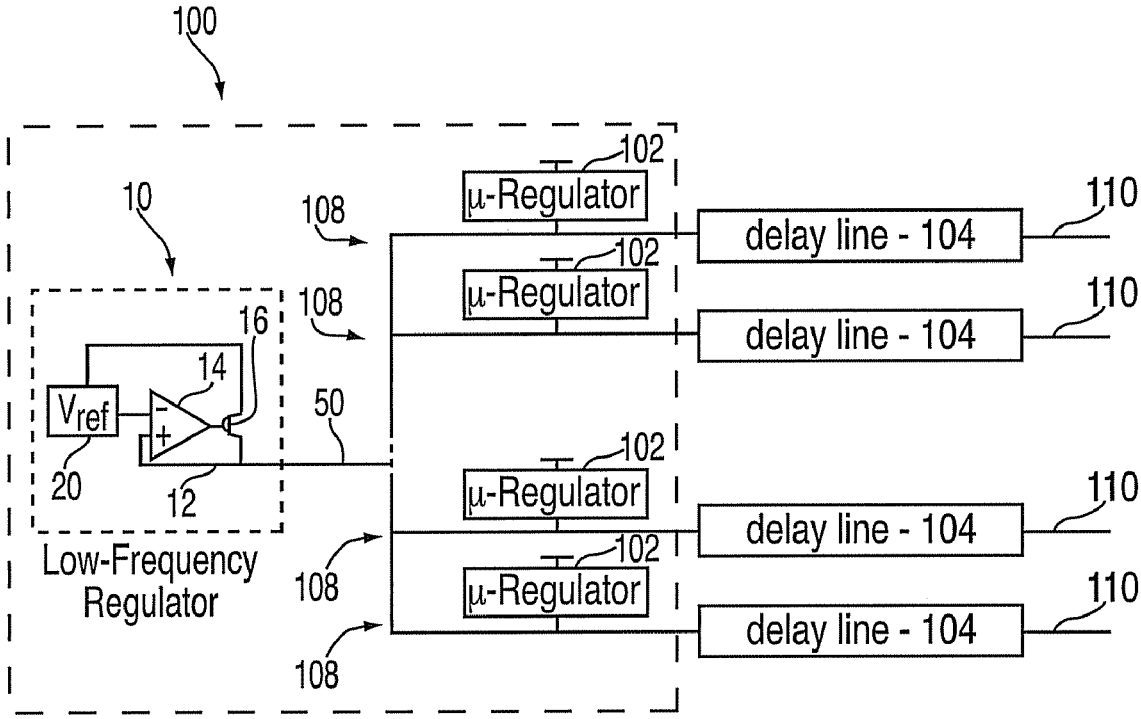
FIG. 1 depicts a variable input voltage regulator that may be implemented by exemplary embodiments.

Turning now to FIG. 1, a voltage regulation circuit 100 is shown employing a low-frequency regulator 10 and multiple high-frequency micro-regulators 102 in accordance with one illustrative embodiment as a variable input voltage regulator system. To avoid usage of large decoupling capacitors, the illustrative embodiment includes the high-frequency micro-regulators 102 in addition to a low-frequency feedback loop 12 provided by the low-frequency regulator 10. The micro-regulators 102 are placed close to each delay line 104 for regulating high-frequency noise that is not filtered out by the low-frequency regulator 10. In one embodiment, the micro-regulators 102 are placed between about 10 microns and 20 microns from its respective delay line 104, more preferably less than 10 microns away. However, in other embodiments, each micro-regulator regulator 102 may be placed greater than 20 microns away from its respective delay line 104.

In an exemplary embodiment, the low-frequency regulator 10 is coupled to a node 50, and a plurality of delay branches 108 are coupled to the node 50 to receive a voltage output to the node 50 by the low-frequency regulator 10. Each of the plurality of delay branches 108 includes a micro-regulator 102 and a delay line 104. The delay line 104 is coupled to the micro-regulator 102 such that unfiltered noise is removed locally at each delay branch 108 by a corresponding micro-regulator 102.

In one embodiment, the low frequency regulator 10 filters out low frequency noise for lower frequencies (e.g., in the lower half of a noise spectrum) while the micro-regulators 102 filter out noise in a higher frequency range (e.g., upper half of the noise frequency spectrum). By providing the filtering locally in multiple stages, higher bandwidth is made available for the circuit/device 100 to operate.

The micro-regulators 102 are preferably placed adjacent to and near the delay lines 104 that they are associated with (preferably about 10 microns away). The micro-regulators 102 may be tailored to specific delay line requirements and may be designed to filter different frequency ranges or to provide or condition the voltage to each delay line 104. The micro-regulators 102 can be configured as described in U.S. application Ser. No. 12/030,946, entitled "Delay Line Regulation Using High-Frequency Micro-Regulators", Dreps et al., filed Feb. 14, 2008, which is hereby incorporated herein by reference in its entirety.

The delay lines 104 may be coupled to various circuits through outputs 110. For example, the delay lines 104 can be employed to adjust signal timing, such as DDR3 data line (DQ) delays so that data strobes (DQS) can sample at an optimum point. Controlling voltage to the delay lines 104 can shift the timing of the outputs 110. The outputs 110 may be coupled to logic circuits, such as memory logic circuits or any other circuit. Circuit 100 may be employed in a memory buffer, a memory controller, receiver chips, memory chips or any other circuit. For example, multiple copies of the circuit 100 can be implemented on a single memory buffer chip to control timing of sampling of data signals, e.g., in groups of 16 data lines, and the memory buffer can be incorporated on a memory module or in a subsystem to communicate with memory devices.

In an exemplary embodiment, the low-frequency regulator 10 includes feedback loop 12, which includes an error amplifier 14, a switching circuit as p-type field-effect transistor (P-FET) 16, and a voltage reference circuit 20. The low bandwidth of the low-frequency regulator 10 is due to the error amplifier 14 having to drive the large P-FET 16. In one exemplary embodiment, the low-frequency regulator 10 has a bandwidth of approximately 10 Megahertz. The voltage reference circuit 20 is configured to output a desired reference voltage level for driving the low-frequency regulator 10. The voltage reference circuit 20 is configurable to produce a regulated reference voltage from variable voltage inputs, which in turn enables the low-frequency regulator 10 to produce a regulated output voltage on output node 50.

Figure 2:
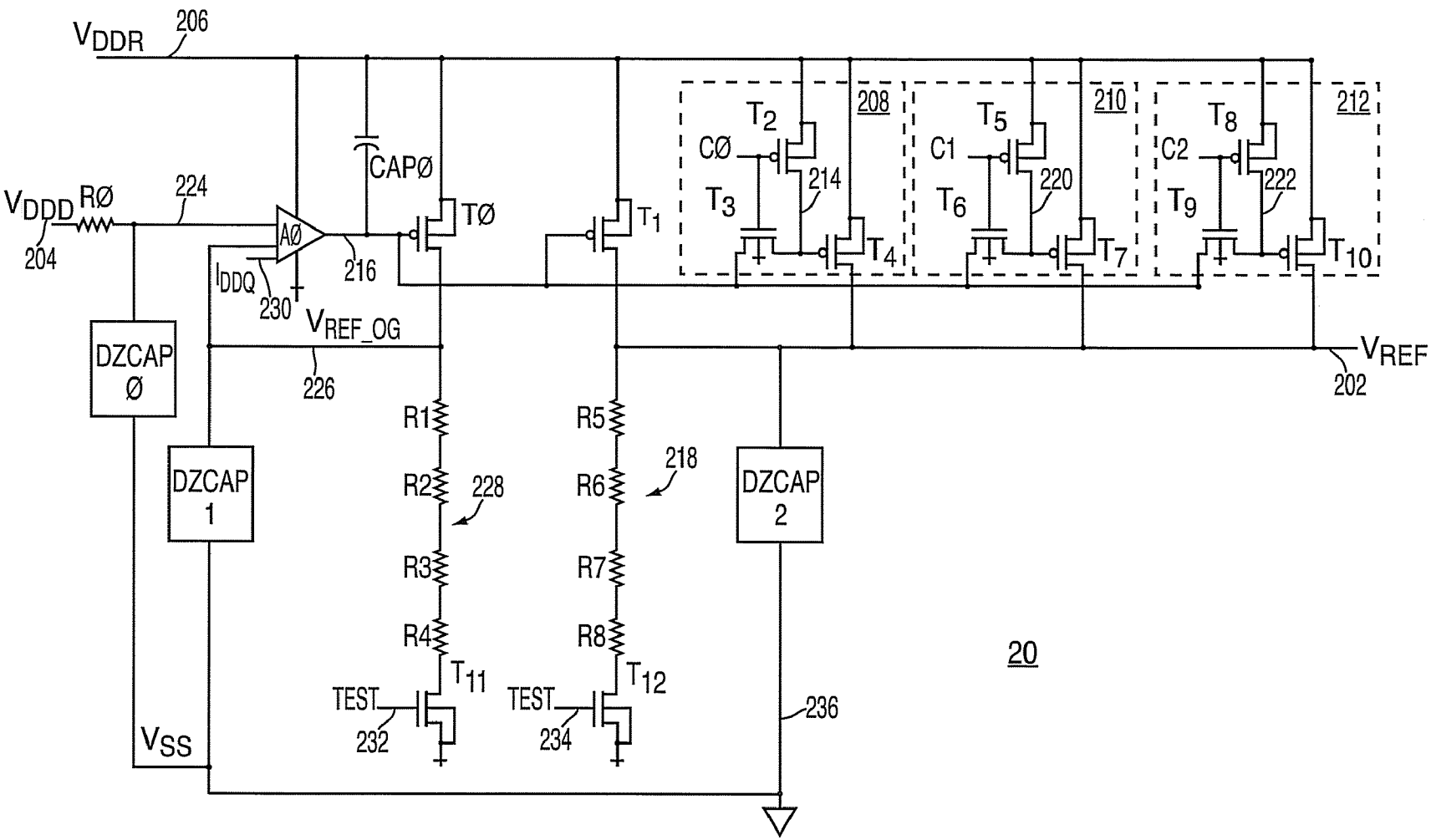
FIG. 2 depicts a reference voltage circuit of a variable input voltage regulator that may be implemented by exemplary embodiments.

Referring to FIG. 2, an illustrative circuit layout is shown for the voltage reference circuit 20 of FIG. 1 in accordance with one illustrative embodiment. The voltage reference circuit 20 regulates output voltage Vref 202 as a function of an input voltage Vddd 204, where the output voltage Vref 202 is greater than or equal to the input voltage Vddd 204. The output voltage Vref 202 drives the negative input (−) of the error amplifier 14 and is also electrically coupled to the P-FET 16 of FIG. 1. In order to maintain a fixed voltage level within a tolerance band at the output voltage Vref 202, additional current can be sourced from supply voltage Vddr 206 when the supply from Vddd 204 is insufficient. For example, Vddd 204 may range between 0.7 and 1.1 volts, while Vref 202 may require a voltage in the range of 0.9 and 1.1 volts. The voltage reference circuit 20 can enable one or more current switching circuits, such as current switching circuits 208, 210, and 212, to add current to Vref 202. Each of the current switching circuits 208-212 is independently configurable via mode pins c0, c1, and c2. The mode pins c0, c1, and c2 can be set or cleared using software or firmware using a register with specific bits mapped to each of the mode pins c0, c1, and c2.

In an exemplary embodiment, each of the current switching circuits 208-212 includes three transistors to control the switching of additional current from Vddr 206 to Vref 202. For example, in current switching circuit 208, c0 serves as a gate input to P-FET T2 and N-FET T3, where P-FET T2 is electrically coupled to Vddr 206 and node 214, and N-FET T3 is electrically coupled to node 216 and node 214. Node 214 provides a gate input to P-FET T4, which is electrically coupled to Vddr 206 and Vref 202. Node 216 is output from operational amplifier (op-amp) A0. When the voltage at c0 is sufficiently high to be "on", or a logical "1" from the software/firmware perspective, the current switching circuit 208 draws additional current from Vddr 206 and outputs the additional current to Vref 202 via P-FET T4. The increased current results in an increase in voltage on Vref 202 since the resistance/impedance remains unchanged in series of resistors 218. Similarly, the current switching circuit 210 includes P-FET T5 electrically coupled to Vddr 206 and node 220, as controlled by c1. C1 also provides gating for N-FET T6, which is electrically coupled to nodes 216 and 220. P-FET T7 is electrically coupled to Vddr 206 and Vref 202, as controlled by node 220. The current switching circuit 212 includes P-FET T8 electrically coupled to Vddr 206 and node 222, as controlled by c2. C2 further provides gating for N-FET T9, which is electrically coupled to nodes 216 and 222. P-FET T10 is electrically coupled to Vddr 206 and Vref 202, as controlled by node 222.

In an exemplary embodiment, input voltage Vddd 204 is filtered by resistor R0 in combination with decoupling capacitor DZCAP0 at a filtered input voltage 224. The op-amp A0 serves as a voltage-to-current converter between inputs of the filtered input voltage 224 and Vref_og 226, which is a switched feedback controlled signal of P-FET T0 as controlled by the output of A0 at node 216. Vref_og 226 is also electrically coupled to a decoupling capacitor DZCAP1 and a series of resistors 228. Capacitor cap0 provides feedback stability to the voltage-to-current converter embodied as op-amp A0. The op-amp A0 may also support testing for manufacturing faults using input Iddq 230. As part of the voltage-to-current conversion, a current mirror circuit is employed, including P-FET T0 electrically coupled to Vddr 206 and the series of resistors 228 controlled by the output of A0 at node 216, with the current mirrored to P-FET T1. P-FET T1 is electrically coupled to Vddr 206 and the series of resistors 218, as controlled by the output of A0 at node 216. Although the series of resistors 228 is depicted as including resistors R1, R2, R3, and R4 in series, it will be understood that a varying number and combination of resistors can be used to achieve equivalent results. Similarly, the series of resistors 218 is depicted as including resistors R5, R6, R7, and R8 in series, which can also vary in number and combination of resistors to achieve equivalent results. The series of resistors 228 and 218 may include configurable switches, such as N-FETs T11 and T12, in series respectively to enable or disable current mirroring through the series of resistors 228 and 218 using test inputs 232 and/or 234. An additional decoupling capacitor DZCAP2 can be included between Vref 202 and steady state voltage Vss 236 to provide additional high frequency filtering of Vref 202.

Although the exemplary circuit depicted in FIG. 2 provides specific examples of numbers of components and interconnections, it will be understood that equivalents are also covered within the scope of the invention, such as changing the number of specific components that produce an equivalent effect or reversing logic states between the various transistors and the like. Moreover, while FIG. 2 shows three current switching circuits 208-212, more or fewer current switching circuits may be employed to permit different amounts of current to be output to Vref 202.

The values of Vddd 204 and Vddr 206 may be configured using different circuits (not depicted), and thus the values are known when setting the mode pins c0, c1, and c2. An exemplary configuration table for regulating Vref 202 to a constant value as a function of Vddd 204 and Vddr 206 using the mode pins c0-c2 is provided in table 1 (when Vddr 206 is set to 1.2V).

TABLE 1

Example mode settings as a function of Vddr and Vddd

| When Vddr = 1.2 | c0, c1, c2 |
|---|---|
| Vddd = 1.0 | 000 |
| Vddd = 0.9 | 001 |
| Vddd = 0.8 | 011 |
| Vddd = 0.7 | 111 |

In this example, Vref 202 is regulated to 1.0 Volt +/±2% for the combinations listed in table 1 using the voltage reference circuit 20. Since the primary input used for regulating Vref 202 is Vddd 204, which is less than or equal to Vref 202, Vref 202 cannot experience an over-voltage condition that would drive Vref 202 over its tolerance threshold. For example, if Vddr 206 represents a programmable voltage rail compatible with multiple generations of DDR memory (e.g., 1.8 V, 1.5 V, 1.3 V, or 1.2V), using this rail to regulate a 1.0 V output of Vref 202 could result in outputting a voltage that is too high when a user incorrectly set the mode pins c0-c2, leading to potential damage of circuits that rely upon Vref 202 as depicted in FIG. 1.

Figure 3:
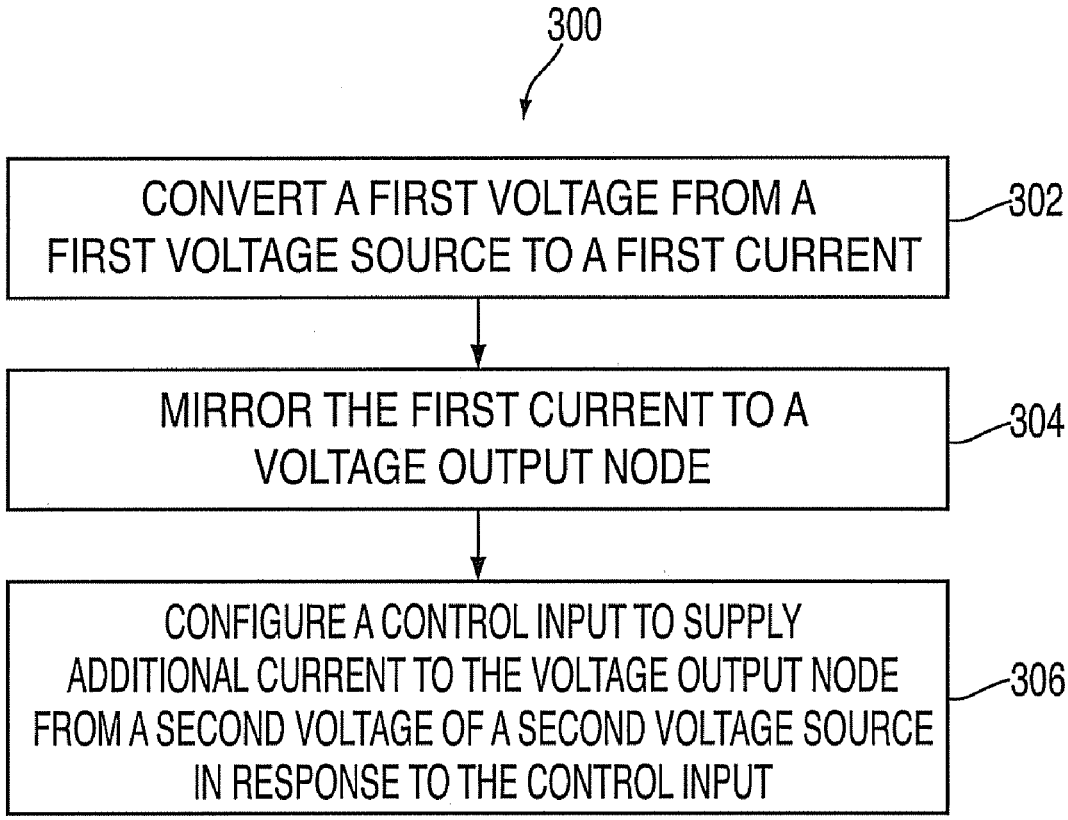
FIG. 3 depicts an exemplary process for variable input voltage regulation that may be implemented by exemplary embodiments.

FIG. 3 depicts a process 300 for providing variable input voltage regulation that may be implemented as described in reference to FIGS. 1 and 2. The process 300 may be implemented in voltage regulation circuit 100 as part of a memory buffer device configured to control accesses to one or more memory devices. At block 302, the voltage reference circuit 20 converts a first voltage from a first voltage source to a first current. The first voltage source may be a digital voltage source, such as Vddd 204, which can be further filtered prior to current conversion at the op-amp A0. At block 304, the voltage reference circuit 20 mirrors the first current to a voltage output node at Vref 202. The current mirroring may be performed via a P-FET current mirror, where the current through P-FET T0 and the series of resistors 228 is mirrored to P-FET T1 and series of resistors 218. When the voltage provided by Vddd 204 is insufficient, a combination of one or more mode pins c0-c2 can be set to increase the current for Vref 202. At block 306, the voltage reference circuit 20 configures a control input to supply additional current to the voltage output node from a second voltage of a second voltage source in response to the control input. The current switching circuits 208-212 can be configured to supply current from the analog voltage supply Vddr 206 as the second voltage source in response to the values of c0-c2 as configured by software of firmware. Thus, the output value of Vref 202 is determined as a function of both Vddd 204 and Vddr 206, as well as the mode pins c0-c2, providing a stable reference voltage for the low-frequency regulator 10. The output of the low frequency regulator 10 can be branched out to multiple outputs, with localized regulation to remove higher frequency noise using multiple micro-regulators 102 in close physical proximity to the outputs (e.g., delays lines 104).

Figure 4:
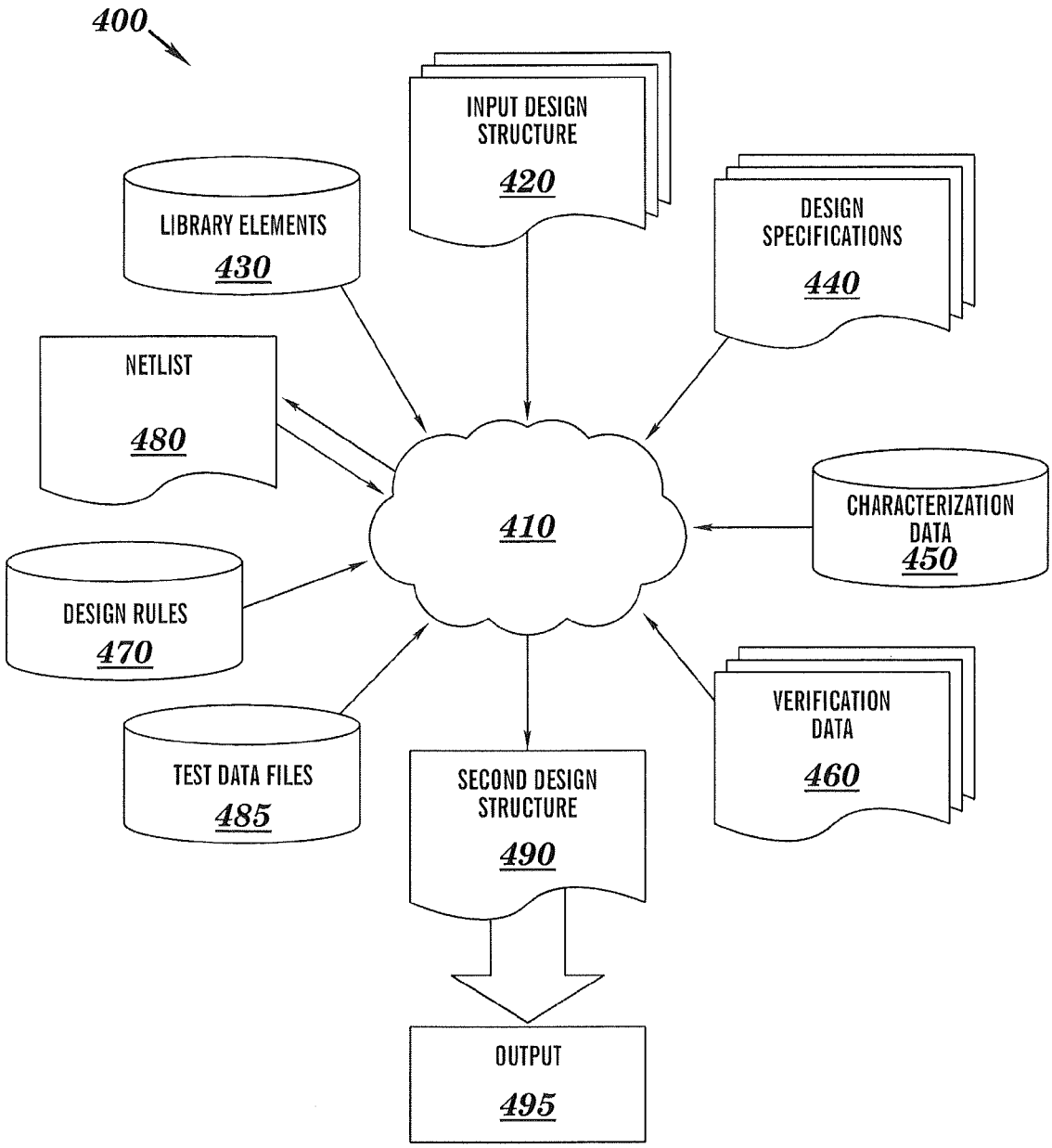
FIG. 4 is a flow diagram of a design process used in semiconductor design, manufacture, and/or test.

FIG. 4 shows a block diagram of an exemplary design flow 400 used for example, in semiconductor IC logic design, simulation, test, layout, and manufacture. Design flow 400 includes processes and mechanisms for processing design structures or devices to generate logically or otherwise functionally equivalent representations of the design structures and/or devices described above and shown in FIGS. 1-3. The design structures processed and/or generated by design flow 400 may be encoded on machine readable transmission or storage media to include data and/or instructions that when executed or otherwise processed on a data processing system generate a logically, structurally, mechanically, or otherwise functionally equivalent representation of hardware components, circuits, devices, or systems. Design flow 400 may vary depending on the type of representation being designed. For example, a design flow 400 for building an application specific IC (ASIC) may differ from a design flow 400 for designing a standard component or from a design flow 400 for instantiating the design into a programmable array, for example a programmable gate array (PGA) or a field programmable gate array (FPGA) offered by Altera® R Inc. or Xilinx® Inc.

FIG. 4 illustrates multiple such design structures including an input design structure 420 that is preferably processed by a design process 410. Design structure 420 may be a logical simulation design structure generated and processed by design process 410 to produce a logically equivalent functional representation of a hardware device. Design structure 420 may also or alternatively comprise data and/or program instructions that when processed by design process 410, generate a functional representation of the physical structure of a hardware device. Whether representing functional and/or structural design features, design structure 420 may be generated using electronic computer-aided design (ECAD) such as implemented by a core developer/designer. When encoded on a machine-readable data transmission, gate array, or storage medium, design structure 420 may be accessed and processed by one or more hardware and/or software modules within design process 410 to simulate or otherwise functionally represent an electronic component, circuit, electronic or logic module, apparatus, device, or system such as those shown in FIGS. 1-3. As such, design structure 420 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 410 preferably employs and incorporates hardware and/or software modules for synthesizing, translating, or otherwise processing a design/simulation functional equivalent of the components, circuits, devices, or logic structures shown in FIGS. 1-3 to generate a netlist 480 which may contain design structures such as design structure 420. Netlist 480 may comprise, for example, compiled or otherwise processed data structures representing a list of wires, discrete components, logic gates, control circuits, I/O devices, models, etc. that describes the connections to other elements and circuits in an integrated circuit design. Netlist 480 may be synthesized using an iterative process in which netlist 480 is resynthesized one or more times depending on design specifications and parameters for the device. As with other design structure types described herein, netlist 480 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 410 may include hardware and software modules for processing a variety of input data structure types including netlist 480. Such data structure types may reside, for example, within library elements 430 and include a set of commonly used elements, circuits, and devices, including models, layouts, and symbolic representations, for a given manufacturing technology (e.g., different technology nodes, 32 nm, 45 nm, 90 nm, etc.). The data structure types may further include design specifications 440, characterization data 450, verification data 460, design rules 470, and test data files 485 which may include input test patterns, output test results, and other testing information. Design process 410 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 410 without deviating from the scope and spirit of the invention. Design process 410 may also include modules for performing standard circuit design processes such as timing analysis, verification, design rule checking, place and route operations, etc.

Design process 410 employs and incorporates logic and physical design tools such as HDL compilers and simulation model build tools to process design structure 420 together with some or all of the depicted supporting data structures along with any additional mechanical design or data (if applicable), to generate a second design structure 490. Design structure 490 resides on a storage medium or programmable gate array in a data format used for the exchange of data of mechanical devices and structures (e.g. information stored in a IGES, DXF, Parasolid XT, JT, DRG, or any other suitable format for storing or rendering such mechanical design structures). Similar to design structure 420, design structure 490 preferably comprises one or more files, data structures, or other computer-encoded data or instructions that reside on transmission or data storage media and that when processed by an ECAD system generate a logically or otherwise functionally equivalent form of one or more of the embodiments of the invention shown in FIGS. 1-3. In one embodiment, design structure 490 may comprise a compiled, executable HDL simulation model that functionally simulates the devices shown in FIGS. 1-3.

Design structure 490 may also employ a data format used for the exchange of layout data of integrated circuits and/or symbolic data format (e.g. information stored in a GDSII (GDS2), GL1, OASIS, map files, or any other suitable format for storing such design data structures). Design structure 490 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 1-3. Design structure 490 may then proceed to a stage 495 where, for example, design structure 490: proceeds to tape-out, is released to manufacturing, is released to a mask house, is sent to another design house, is sent back to the customer, etc.

The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

Technical effects include an on chip variable input voltage regulator in a compact design. While other approaches to voltage regulation may employ techniques such as band gap regulation, the regulation of a reference voltage as described herein uses a simple approach to provide a fixed output voltage from variable voltage sources with reduced complexity. Regulating from a lower voltage input and adding current as needed from a higher voltage variable input, such as a programmable DDR voltage rail, protects against over-voltage conditions. Mode pins allow for fine adjustments to the regulated output as a function of an input voltage and an additional current source.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/ or components, but do not preclude the presence or addition of one or more other features, integers, steps, operations, elements, components, and/or groups thereof The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated. Moreover, the use of the terms first, second, etc. do not denote any order or importance, but rather the terms first, second, etc. are used to distinguish one element from another.

What is claimed is:

1. A variable input voltage regulator comprising:

a first circuit configured to convert a first voltage from a first voltage source to a first current;

a second circuit electrically coupled to the first circuit and configured to mirror the first current to a voltage output node; and a third circuit electrically coupled to the voltage output node of the second circuit and configured to supply additional current to the voltage output node from a second voltage of a second voltage source in response to a control input, the third circuit including a first transistor electrically coupled to the second voltage source, to the control input and to a node, the node connecting a second transistor and a third transistor, the second transistor electrically coupled to an output of the first circuit and to the control input, and the third transistor electrically coupled to the second voltage source and to the voltage output node.

2. The variable input voltage regulator of claim 1 wherein the first voltage source is a digital voltage source and the second voltage source is an analog voltage source.

3. The variable input voltage regulator of claim 1 wherein the second voltage is greater than the first voltage.

4. The variable input voltage regulator of claim 1 wherein the first circuit further comprises a filter circuit configured to remove frequency components of the first voltage in a first frequency range prior to converting to the first current.

5. The variable input voltage regulator of claim 1 wherein the first circuit further comprises an operational amplifier to convert the first voltage to the first current.

6. The variable input voltage regulator of claim 5 wherein the second circuit comprises a current mirror configured to mirror the first current to the voltage output node, the current mirror comprising:

a first p-type field-effect transistor (P-FET) electrically coupled to a first series of resistors, a feedback path of the operational amplifier, and the second voltage source; and a second P-FET electrically coupled to a second series of resistors, the voltage output node, and the second voltage source.

7. The variable input voltage regulator of claim 6 wherein the first series of resistors is electrically coupled to a first test FET and the second series of resistors is electrically coupled to a second test FET, the first and second test FETs providing a disabling function to test the current mirror.

8. The variable input voltage regulator of claim 1 wherein the first transistor is a P-FET, the second transistor is a N-FET, and the third transistor is a P-FET.

9. The variable input voltage regulator of claim 1 further comprising a plurality of the third circuit electrically coupled to the voltage output node of the second circuit and configured to supply additional current to the voltage output node from the second voltage of the second voltage source in response to a plurality of control inputs.

10. The variable input voltage regulator of claim 9 wherein the plurality of control inputs is configurable to regulate the voltage output node as a function of the first voltage and the second voltage.

11. The variable input voltage regulator of claim 1 wherein the first voltage is between 0.7 and 1.0 Volt, the second voltage is between 1.2 and 1.8 Volts, and the voltage output node is regulated within two percent of 1.0 Volt.

12. A system for variable input voltage regulation, comprising:

a low frequency regulator comprising a variable input voltage reference circuit electrically coupled to an error amplifier and a switching circuit, wherein the variable input voltage reference circuit is configured to supply additional current from a second voltage of a second voltage source to a first current from a first voltage of a first voltage source to produce a reference voltage in response to a control input, the variable input voltage reference circuit comprising:

a first transistor electrically coupled to the second voltage source, to the control input and to a node, the node connecting a second transistor and a third transistor, the second transistor electrically coupled to an output of the error amplifier and to the control input, and the third transistor electrically coupled to the second voltage source and to the voltage output node; and a plurality of micro-regulators electrically coupled to an output of the low frequency regulator, wherein the plurality of micro-regulators filter noise in a higher frequency range as compared to the low frequency regulator.

13. The system of claim 12 wherein each of the micro-regulators is electrically coupled to a delay line to control timing to sample a signal.

14. The system of claim 13 wherein the system is in a memory buffer device, and the signal to sample is a data signal of a memory device as sampled using a data strobe delayed by the delay line.

15. The system of claim 12 wherein the first voltage source is a digital voltage source and the second voltage source is an analog voltage source, and the second voltage is greater than the first voltage.

16. The system of claim 12 further comprising a plurality of variable input voltage reference circuits configured to supply additional current from the second voltage of the second voltage source in response to a plurality of control inputs.

17. The system of claim 12 wherein the first transistor is a P-FET, the second transistor is a N-FET, and the third transistor is a P-FET.

18. A method for variable input voltage regulation, the method comprising:

converting a first voltage from a first voltage source to a first current;

mirroring the first current to a voltage output node; and configuring a control input to supply additional current to the voltage output node from a second voltage of a second voltage source in response to the control input, the configuring including electrically coupling a first transistor to the second voltage source, to the control input and to a node, the node connecting a second transistor and a third transistor, electrically coupling the second transistor to an output of the converting and to the control input, and electrically coupling the third transistor to the second voltage source and to the voltage output node.

19. The method of claim 18 wherein the first voltage source is a digital voltage source and the second voltage source is an analog voltage source, and the second voltage is greater than the first voltage.

20. The method of claim 18 further comprising a plurality of control inputs configured to supply additional current from the second voltage of the second voltage source in response to a plurality of control inputs, wherein the plurality of control inputs is configurable to regulate the reference voltage as a function of the first voltage and the second voltage.

21. A design structure tangibly embodied in a machine-readable medium for designing, manufacturing, or testing an integrated circuit, the design structure comprising:

a first circuit configured to convert a first voltage from a first voltage source to a first current;

a second circuit electrically coupled to the first circuit and configured to mirror the first current to a voltage output node; and a third circuit electrically coupled to the voltage output node of the second circuit and configured to supply additional current to the voltage output node from a second voltage of a second voltage source in response to a control input, the third circuit including a first transistor electrically coupled to the second voltage source, to the control input and to a node, the node connecting a second transistor and a third transistor, the second transistor electrically coupled to an output of the first circuit and to the control input, and the third transistor electrically coupled to the second voltage source and to the voltage output node.

22. The design structure of claim 21, wherein the design structure comprises a netlist.

23. The design structure of claim 21, wherein the design structure resides on storage medium as a data format used for the exchange of layout data of integrated circuits.

24. The design structure of claim 21, wherein the design structure resides in a programmable gate array.

* * * * *